US006460852B1

(12) United States Patent
Tallian

(10) Patent No.: US 6,460,852 B1
(45) Date of Patent: Oct. 8, 2002

(54) ELECTRONIC OR BOARD GAME INVOLVING THE CAPTURE OF FICTIONAL CHARACTERS AND A METHOD FOR PLAYING SAME

(76) Inventor: Marion E. Tallian, 207 S. Owen St., Mt. Prospect, IL (US) 60056

( * ) Notice: Subject to any disclaimer, the term of this patent is extended or adjusted under 35 U.S.C. 154(b) by 0 days.

(21) Appl. No.: 09/633,427

(22) Filed: Aug. 7, 2000

(51) Int. Cl.[7] ..... A63F 3/00
(52) U.S. Cl. ..... 273/243; 273/308
(58) Field of Search ..... 273/236, 237, 273/243, 246, 248, 249, 260, 261, 308, 244.2, 293, 296, 252, 251

(56) References Cited

U.S. PATENT DOCUMENTS 4,272,337 A * 6/1981 Carrera
4,575,095 A * 3/1986 Gaster
5,190,292 A * 3/1993 Perry
5,544,891 A * 8/1996 Gibson
6,120,296 A * 9/2000 Lim

OTHER PUBLICATIONS

Gameplay/Jan. 1984 (12 pages).*

* cited by examiner

*Primary Examiner*—Benjamin H. Layno
*Assistant Examiner*—Vishu K Mendiratta
(74) *Attorney, Agent, or Firm*—Patents + TMS, P.C.

(57) ABSTRACT

The present invention provides a game, played on an electronic or tangible board, in which the theme of the game is the capture of characters, such as mobsters. In addition, the present invention provides a method for playing the game. A minimum of two players play the game. In the game, a mobster may be represented by a card bearing an illustration of the mobster. A player, acting as an agent, for example, of the law, captures a mobster by acquiring the mobster card for the particular corresponding mobster. A player may then place the corresponding mobster's card in a section of a game board designated as a player's personal penitentiary. Placement of a mobster card in the area designated as a player's personal penitentiary represents placement of that mobster in a prison. A secondary object of the game is to obtain the highest amount of money of any participating player.

6 Claims, 3 Drawing Sheets

ELECTRONIC OR BOARD GAME INVOLVING THE CAPTURE OF FICTIONAL CHARACTERS AND A METHOD FOR PLAYING SAME

BACKGROUND OF THE INVENTION

The present invention generally relates to a game. More specifically, the present invention relates to a game played on a tangible game board or electronically through use of the internet, a computer disk, or the like. The theme of the game relates to the capture of fictional characters, such as mobsters.

It is, of course, generally known to provide a game incorporating, for example, a game board, dice, instructional cards and the like. Such game boards are often designed around a particular theme, such as attaining real estate, solving a mystery or the like. Many such games are very complex to learn and/or to play. Further, many known games are time-consuming and tedious with very little interest to many individuals for participating in or playing the particular game.

However, no games are known that relate to capture of specific characters, such as mobsters, wherein the players of the game act as fictional agents. Further, no games are known which involve players adhering to monetary guidelines while attempting to capture specific characters, such as mobsters.

A need, therefore, exists for a game and a method for playing the game having a theme involving the capture of specific characters, such as mobsters. Further, a need exists for a game wherein participants capture specific characters, such as mobsters, while adhering to monetary guidelines. Still further, a need exists for a game involving the same which may be played electronically.

SUMMARY OF THE INVENTION

The present invention provides a game involving the capture of characters, such as mobsters, and the management of monies allocated to each of the players. Further, the present invention provides a method for playing the game.

In an embodiment of the present invention, a game board assembly is provided. The game board assembly may have a game surface having an outer perimeter having spaces and displaying a representation of a mobster within one of the spaces and further having an interior having a penitentiary section designating a figurative prison. The game board assembly may also have a mobster card bearing an illustration of a mobster wherein the card is placed in the penitentiary section representing a holding of the mobster within the figurative prison.

In an embodiment, the game board assembly has a game card displaying instructions.

In an embodiment, the spaces of the game board assembly include instructions.

In an embodiment, the game board assembly has a plurality of penitentiary sections within the interior of the game surface.

In an embodiment, each of the plurality of penitentiary sections are numbered.

In an embodiment, the game board assembly has a plurality of tokens.

In another embodiment of the present invention a method for playing a game by a plurality of players of the game is provided. The method has the step of providing a game surface having an outer perimeter and further having spaces around the outer perimeter wherein one of the spaces displays a representation of a mobster. The method further has the step of providing a penitentiary section designating a figurative prison wherein one of the players of the game places a card bearing an illustration of a mobster representing a holding of the mobster within the figurative prison. In addition, the method has the step of collecting the card having the illustration of the mobster. Still further, the method has the step of placing the card having the illustration of the mobster on the penitentiary section.

In an embodiment, the method further has the step of providing a plurality of penitentiary sections.

In an embodiment, the method further has the step of numbering the penitentiary sections in the plurality of penitentiary sections.

In an embodiment, the method further has the step of providing a plurality of tokens.

In an embodiment, the method further has the step of rolling one or more dice.

In an embodiment, the method further has the step of positioning the token onto a space located within the continuous path of the game surface.

In an embodiment, the method further has the step of reading instructions displayed on the space.

In an embodiment, the method further has the step of reading instructions displayed on a game card.

It is, therefore, an advantage of the present invention to provide a game and a method for playing the same having an entertaining theme such as the capture of specific characters, such as mobsters.

Still another advantage of the present invention is to provide a game and a method for playing the same providing competition between players of the game.

Yet another advantage of the present invention is to provide a game and a method for playing the same having an entertaining theme relating to money management.

Still another advantage of the present invention is to provide a game and a method for playing the same having an aesthetically decorated playing surface.

Yet another advantage of the present invention is to provide a game and a method for playing the same having aesthetically decorated playing pieces such as cards, chips, figures and the like.

Another advantage of the present invention is to provide a game and a method for playing the same having exciting figurative situations for a player to encounter and/or ramifications as a result of a specific situation.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a game, played on an electronic or tangible board, in which a theme of the game is the capture of specific characters, such as mobsters. In addition, the present invention provides a method for playing the game.

Preferably, six players may play against each other during a game. However, a minimum of two players may be required to play the game. Each player may use a figure decorated, for example, as an agent, as that player's representative for use in playing the game. In the game, a mobster may be represented by a card bearing an illustration of the mobster. A player, acting as an agent of the law, for example, may capture a mobster by acquiring a mobster card of a corresponding mobster. A player may then place the corresponding mobster card in a section of the game board designated as a player's personal penitentiary. Placement of the mobster card in the area designated as a player's personal penitentiary may represent placement of that mobster in a prison, for example.

The primary object amongst players is to capture the greatest number of mobsters by collecting the greatest number of corresponding mobster cards. A secondary object of the game is to obtain the highest amount of money of any player involved. Money may be collected by capturing a mobster. The mobster may have a reward amount for the mobster's capture designated on the mobster's corresponding mobster card. Money may also be collected by having a player's figure occupy spaces on the game board that offer monetary awards to the corresponding player.

Figure 1:
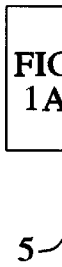
FIG. 1 illustrates a diagram of an arrangement of FIG. 1A and FIG. 1B to create a composite view of a board in an embodiment of the present invention.
Figure 1A:
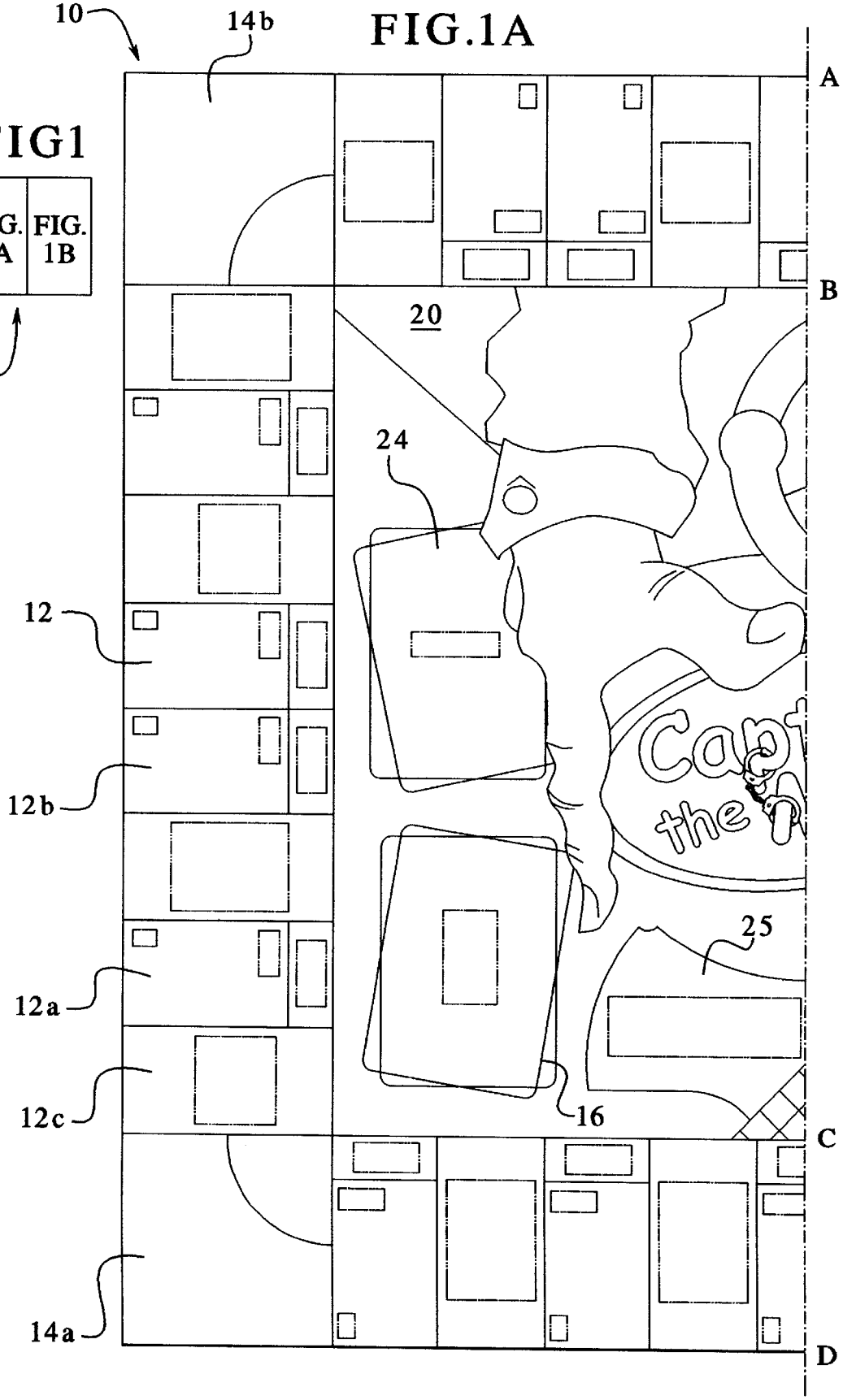
FIG. 1A illustrates a plan view of a portion of the game board in an embodiment of the present invention.
Figure 1B:
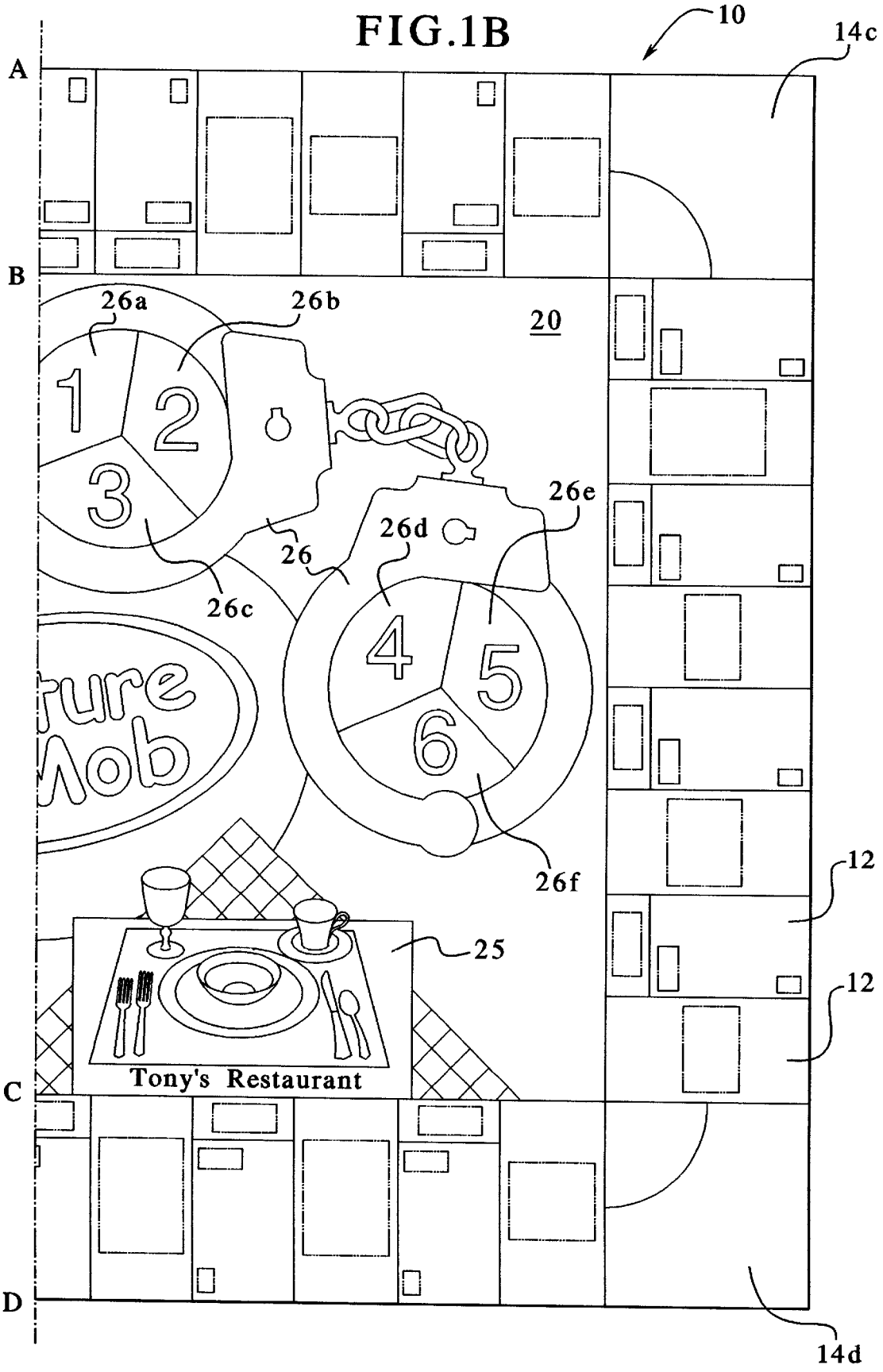
FIG. 1B illustrates a plan view of a portion of the game board in an embodiment of the present invention.

Referring now to the drawings wherein like numerals refer to like parts, FIG. 1 illustrates an arrangement 5 of FIGS. 1A and 1B which together form a board shown divided at the line ABCD.

FIGS. 1A and 1B illustrate a plan view of a game board 10 which may be constructed, for example, from wood, paper, cardboard or other material known by those skilled in the art. In addition, in an electronic embodiment of the game, the game board 10 may be generated on, for example, a computer screen or monitor using appropriate computer code, software or the like and/or may be accessible via the internet, for example. The game board 10 may be rectangular and may have a continuous path 11 around its perimeter. The path 11 may be divided into spaces 12. The game board 10 may have, for example, eight spaces 12 on each side of the game board 10. The spaces 12 may be rectangular and may have various illustrations and/or instructions. For example, a certain space 12*a* may prompt a player to draw and read a card 202 from a stack 200 of cards 202 in a designated card area 16. In another example, a space 12*b* may inform a player of a figurative situation in which the player may be involved, such as a promotion, and/or the effects of the situation on a player's personal fund. In yet another example, a space 12*c* may have an illustration of, for example, a mobster that may be apprehended by, for example, a player. (The spaces 12*a*, 12*b* and 12*c* are collectively referred to hereinafter as "the spaces 12".)

The game board 10 may have four corners 14*a*, 14*b*, 14*c* and 14*d* (collectively referred to hereinafter as "the corners 14"). The corners 14 may be larger in area than the spaces 12. The corner 14*a* may provide, for example, a player with a starting point for movement of a figure 306 and may display the words "HEADQUARTERS". The corners 14 may be situated on the board 10 in intervals of eight spaces 12 between each of two corners. In addition, a corner 14*b*, may be designated "WITNESS PROTECTION PROGRAM". The corner 14*b*, if occupied by the player's figure 306, may provide the player with an opportunity to deposit mobster cards 308 that were previously placed in the corner 14*b* into a penitentiary 26 and receive a reward for each mobster card 308 collected as a result of occupying the corner 14*b*. Another corner 14*c* may inform the player of a figurative situation, such as a violent attack upon the player, and the effects of that attack on the player's personal funds, for example. Moreover, a corner 14*d* may inform the player of a figurative situation, such as the loss of monetary funds due to gambling while acting as an undercover agent, for example.

An interior 20 of the board 10 may have various designated areas, such as generally illustrated at 16, 24, 25, and 26, for the placement of various game pieces. For example, the interior 20 of the board 10 may have an area 22 for the placement of one or more of the stack 200 of cards 202 as well as an area 24 for the discarding of a card 202 after the card 202 has been read by the player.

In addition, the interior 20 of the board 10 may contain an area 25 which may be designated as "Tony's Restaurant". The mobster cards 308 may be placed in the area 25 until the mobster cards 308 are collected by a player. For example, if the number of players at the start of the game is less than six, the mobster cards 308 in the bag 302 that are not allocated to any player are placed in the area 25. The mobster card 308 that is in the area 25 may later be collected by a first player in a situation, for example, in which a first player draws a card 202 that displays the word "CAPTURE", allowing the first player to take the mobster card 308 that may be in the possession of a second player. If the second player does not have any mobster cards 308 in the second player's possession, the first player may take the mobster card 308 from the area 25.

Also within the interior 20 of the board 10 may be a penitentiary 26. Preferably, six penitentiaries 26*a*–26*f* may be provided. The mobster card 308 may be placed in the penitentiary 26*a* after the mobster card 308 is collected by the player to symbolize placement of the mobster in the player's penitentiary 26*a*. The penitentiaries 26*a*–26*f* may be numbered and may correspond to a number assigned to a player by a player card 304 which may be found inside of a bag 302 allocated to a player before the start of play.

Figure 2:
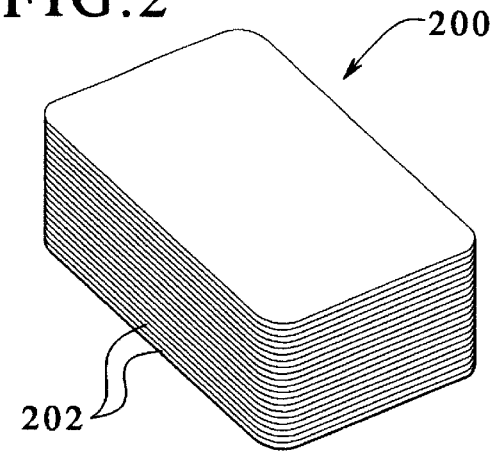
FIG. 2 illustrates a perspective view of cards used to play the game in an embodiment of the present invention.

FIG. 2 illustrates a representation of the stack 200 of cards 202 that may be drawn and read by players during playing of the game. A player may first roll one or more dice 314. The player may then move a figure 306, illustrated in FIG. 3 and described in detail below, which represents the player and traverses the path 11 of the game board 10. The figure 306 may be moved along the continuous path 11 by repositioning the figure 306 within a second space 12*b* or second corner 14*b* which is distant from a first space 12*a* or first corner 14*a* previously occupied by the figure 306 of the player by an amount specified on the dice 314. If, for example, the second space 12 or corner 14 displays the words "PICK A CARD", the player whose figure 306 occupies the second space 12*b* or second corner 14*b* draws the card 202 from the stack 200 of cards 202. A card 202*b* may display, for example, an instruction such as "MOVE BACK 3 SPACES." Another card 202*c* may display, for example, an instruction such as "GO TO THE WITNESS PROTECTION PROGRAM". Still another card 202*d* may display, for example, the word "CAPTURE." Other types of instructions or figurative situations may also be displayed on the stack 200 of cards 202.

Figure 3:
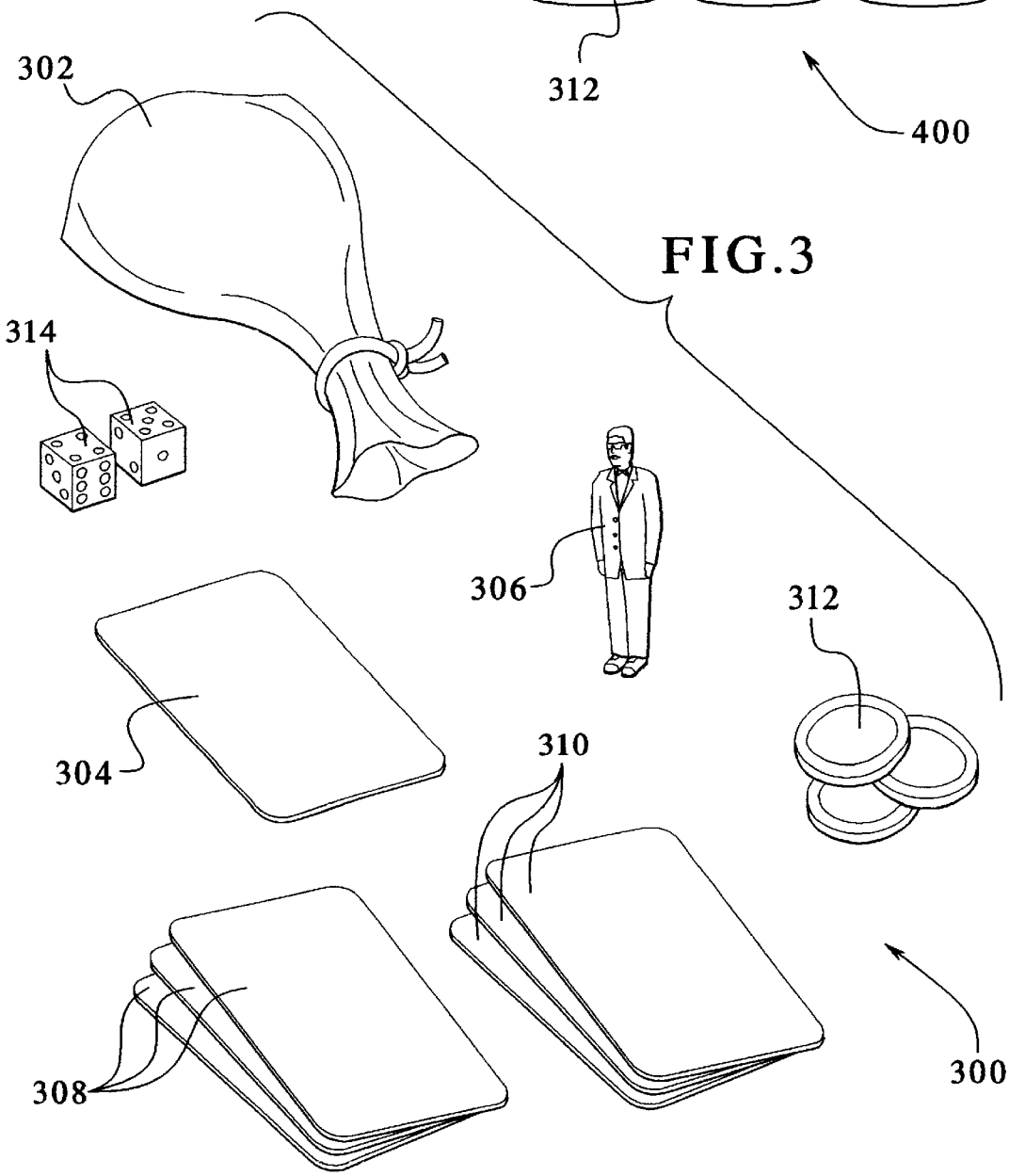
FIG. 3 illustrates a perspective view of various game pieces for playing the game in an embodiment of the present invention.

FIG. 3 illustrates a set 300 consisting of various game pieces hereinafter described with reference to components generally designated by 302, 304, 306, 308, 310, 312 and 314. The set 300 of game pieces may be allocated to the player prior to the start of the game. Preferably, six sets 300 may be used during playing of the game. The player is allocated the bag 302 which may contain the player card 304 which may display a number, for example, between 1 and 6 representing a number of the player's penitentiary 26. The purpose of the number of the penitentiary 26 is, for example, to separate mobster cards 308 collected by a first player and placed into the first penitentiary 26*a* from mobster cards 308 in the possession of a second player who may place the second player's mobster cards 308 in the second player's penitentiary 26*b*.

The bag 302 may also contain a figure 306 which may display, for example, on the back of the figure 306, a number identical to the number displayed on the player card 304. The figure 306 may serve as a token to be placed along the board spaces 12 or the corners 14. The figure 306 may be three-dimensional and may be made from wood, plastic, rubber or the like. The figure 306 may also be decorated, for example, with a black suit and sunglasses to resemble, for example, an agent. The figure 306 may be decorated with paint, ink or the like and/or may be three-dimensional, with the suit and sunglasses constructed from wood, plastic, rubber or the like.

In addition, the bag 302 may contain mobster cards 308. Each of the mobster cards 308 may display a number, for example, between 1 and 6. If less than six players are present at the start of the game, the mobster cards 308 which are not allocated to players within a player's set 300 may be placed in the area 25 designated as "Tony's Restaurant."

The bag 302 may also contain "CAPTURE" cards 310. The "CAPTURE" cards 310 may display the word "CAPTURE" and may also display a number identical to the number displayed on the player card 304. Preferably, three "CAPTURE" cards 310 are present in the bag 302.

The bag 302 may also contain treasury chips 312. The treasury chips 312 may have, for example, various types, such as gold, silver and copper, which may represent various dollar amounts and/or denominations. A player is allocated a certain amount of treasury chips 312, preferably totaling, for example, $600,000. The player may use the treasury chips 312 as a personal fund, if, for example, after reading one of the cards 202 from the stack 200, the player is informed of a situation and/or ramifications of that situation. For example, the card 202 may provide the instruction "GO TO THE CASINO DON'T STOP AT HEADQUARTERS" which involves the loss, for example, of $100,000. A player may also use the treasury chips 312 as a personal fund after occupying the space 12 or the corner 14 that displays text describing a figurative situation, such as, for example the space 12 displaying the instruction "COLLECT $25,000 FOR EXPENSES" in which the player receives $25,000 from a treasury 400.

Figure 4:
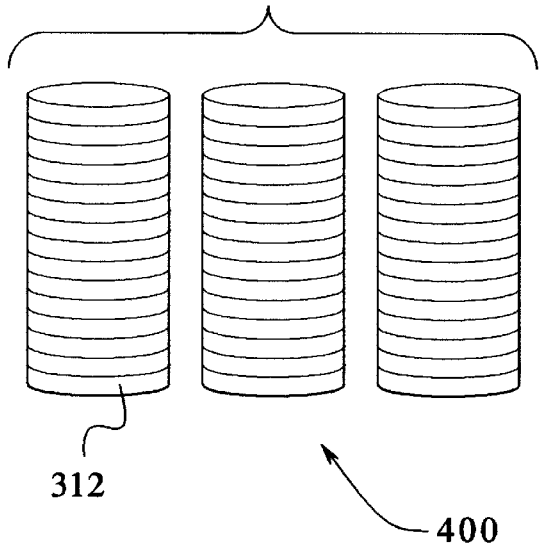
FIG. 4 illustrates a perspective view of treasury chips used for playing the game in an embodiment of the present invention.

FIG. 4 illustrates a representation of the treasury 400 which may contain various types of treasury chips 312 to be allocated amongst players or received from players depending upon the situation in which a player may be involved.

One object of the game is for the player to capture the most mobsters. Another object of the game is to collect the most reward money. To this end, the winner of the game may be determined by a first player who has the greatest number of mobster cards 308 collected from a first player's own bag 302, the area 25 or from a second player, and placed within the first player's personal penitentiary 26. If a tie amongst two or more players results for the greatest number of mobster cards 308 within a personal penitentiary 26, a winner may be determined, for example, by the player who has the greatest number of mobster cards 308 and/or the greatest amount of money.

The order of play amongst players may be determined by a number displayed on the player card 304 in the bag 302. The order may be descending from highest number displayed on the player's card 304 to the lowest number displayed. Each player must initially place his or her figure 306*a*, 306*b*, etc. on the corner 14*a*, which may be the starting point for positioning and repositioning the figures 306*a*, 306*b*, etc. along the continuous path 11 of the board 10. During a player's turn, a player may toss one or more dice 314 and move his or her figure 306 to one of the spaces 12 or one of the corners 14 corresponding to the total displayed on the dice 314 in relationship to the space 12 or the corner 14 previously occupied by the player. After the player's figure 306 completes a revolution of the continuous path 11 of the board 10 beginning at the corner 14*a* displaying the word "HEADQUARTERS", the player may collect money from the treasury 400.

If a first player positions the figure 306 onto the space 12 displaying a mobster, a second player in possession of the corresponding mobster card 308 may be required to give the mobster card 308 to the first player. The second player may also be required to give to the first player the dollar amount designated on the corresponding mobster card 308. If, however, the particular mobster card 308 has already been collected and placed within the second player's personal penitentiary 26*b*, the mobster card 308 may be transferred to the personal penitentiary 26*a* of the first player. In this case, money may not be exchanged between the first player and the second player because the mobster has already been "captured."

If the number of players is less than six, the corresponding mobster card 308 may be removed from the area 25 where the mobster card 308 may have been originally placed at the start of the game. The corresponding mobster card 308 may then be placed within the first player's personal penitentiary 26*a*, and the monetary value of the mobster, designated on the corresponding mobster card 308, may be paid to the first player by the treasury 400. In a situation in which the number displayed on the mobster card 308 is the same as the first player's card 304, the first player may receive, for example, a monetary bonus.

If a player occupies the corner 14*b* entitled "WITNESS PROTECTION PROGRAM", the mobster cards 308 previously placed on the corner 14*b* may be transferred to the player, and the player may be paid the monetary value, as may be identified on the mobster cards 308 of those mobsters, by the treasury 400.

If a first player occupies the space 12 that requires the first player to draw one of the cards 202 from the stack 200, the first player may be required to draw one of the cards 202 and follow the instructions displayed on the card 202. If the first player draws the card 202 that displays the word "CAPTURE", the card 202 may be matched with the "CAPTURE" card 310 found in the first player's bag 302. The drawn card 202 that displays the word "CAPTURE" may then allow a first player to collect the mobster card 308 from a second player. If the mobster card 308 is taken from a second player's set 300, the mobster's designated reward money is paid to the first player. If the second player previously collected and placed the mobster card 308 in his or her penitentiary 26*b*, the mobster card 308 may be transferred to the first player's penitentiary 26*a*. The drawn card 202 displaying the word "CAPTURE" may then be returned to the discard area 24. The "CAPTURE" card 310 taken from a first player's set 300 may then be placed face down and may not be reused. After all three of the "CAPTURE" cards 310 in the bag 302 are used, those "CAPTURE" cards 310 may not be used by any of the other players for the duration of the game.

Because an object of the game is for a player to capture the most mobsters, after all of the mobster cards 308 have been placed in a personal penitentiary 26 of any of the players, the game may be over. In addition, because a secondary objective of the game is for a player to collect the most money during the game, a player may participate despite not collecting any mobster cards 308. However, if at any point a player does not possess any treasury chips 312, that player may then be eliminated from the game.

If a tie amongst players exists for the greatest number of mobster cards 308 within a personal penitentiary 26, a winner may be determined by the player who has the greatest number of mobster cards 308 and/or greatest amount of money, for example.

In an electronic embodiment of the game, the game board 10 may be generated on, for example, a computer screen or monitor using appropriate computer code, software or the like and/or may be downloaded via the internet, for example. The board 10, in electronic form, may be rectangular and may have the continuous path 11 along the perimeter of the board as described with reference to FIGS. 1A and 1B. Each of the spaces 12 or the corners 14 of the board 10 illustrated in FIG. 1A and FIG. 1B may also be displayed in the electronic embodiment of the present invention as well as the area within the interior 20 of the board 10.

The set 200 of cards 202 illustrated in FIG. 2 may be electronically imaged upon a computer screen as well as the individual cards 200*a*. In addition, those items illustrated in FIG. 3, including the set 300 of various game pieces, may also be electronically imaged upon a computer screen.

Furthermore, the method of play may be simulated electronically. For example, computer code may be created involving the dice 314 such that the electronically imaged dice 314 may appear to be rolled by a player by use of a keyboard or other computer hardware, for example.

Also, the figures 306 may be electronically simulated to be positioned and re-positioned along the continuous path 11 of the board 10 during a player's turn subsequent to rolling of the dice 314 by any one of the players.

Moreover, actions such as the exchanging of money with the treasury 400, the drawing of the card 202 from the set 200 of cards 202, collection of the mobster card 308, placement of the mobster card 308 within one of the penitentiaries 26, or transfer of the mobster card 308 between the penitentiary 26*a* of a first player and the penitentiary 26*b* of a second player, or any other action associated with play of the game may also be electronically simulated by appropriate computer code implemented to perform such functions or the like.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A game board assembly for playing a game by at least two players, the assembly comprising:

a game surface having an outer perimeter having spaces and displaying an illustration and name of a mobster within at least one of the spaces and further having an interior area within the outer perimeter spaces of the game surface wherein the interior area has a plurality of penitentiary sections designating a figurative prison;

a mobster card having an illustration and a name of a mobster corresponding to the name and the illustration on at least one of the outer perimeter spaces;

a player card having a number for identifying each of the plurality of players of the game;

a first capture card having a number corresponding to the number on the player card; and a second capture card without a number wherein possession of both the first capture card and the second capture card instructs the player to capture the mobster card and place the mobster card in the penitentiary section representing a holding of the mobster within the figurative prison.

2. The game board assembly of claim 1 further comprising: a game card displaying instructions.

3. The game board assembly of claim 1 wherein the spaces include instructions.

4. The game board assembly of claim 1 further comprising:

a plurality of penitentiary sections within the interior of the game surface.

5. The game board assembly of claim 4 wherein each of the plurality of penitentiary sections are numbered.

6. The game board assembly of claim 1 further comprising: a plurality of tokens.

* * * * *